US010570610B2

(12) United States Patent
Neikes

(10) Patent No.: US 10,570,610 B2
(45) Date of Patent: Feb. 25, 2020

(54) PROFILED RAIL WITH PLUG FOR FASTENING TO FORMWORK

(71) Applicant: Friedrich Wilhelm Neikes, Schwielowsee (DE)

(72) Inventor: Friedrich Wilhelm Neikes, Schwielowsee (DE)

( * ) Notice: Subject to any disclaimer, the term of this patent is extended or adjusted under 35 U.S.C. 154(b) by 0 days.

(21) Appl. No.: 16/252,750

(22) Filed: Jan. 21, 2019

(65) Prior Publication Data

US 2019/0226200 A1 Jul. 25, 2019

(30) Foreign Application Priority Data

Jan. 20, 2018 (DE) ..... 10 2018 101 251

(51) Int. Cl.

| | |
|---|---|
| ***E04B 1/41*** | (2006.01) |
| ***E04G 17/00*** | (2006.01) |
| ***E04G 21/18*** | (2006.01) |
| ***E04G 15/04*** | (2006.01) |

(52) U.S. Cl.

CPC ..... *E04B 1/4107* (2013.01); *E04G 17/002* (2013.01); *E04G 15/04* (2013.01); *E04G 21/185* (2013.01)

(58) Field of Classification Search

CPC ... E04B 1/4107; E04B 1/4135; E04G 17/002; E04G 15/04; E04G 21/18

See application file for complete search history.

(56) References Cited

U.S. PATENT DOCUMENTS

| | | | | | |
|---|---|---|---|---|---|
| 3,157,966 | A * | 11/1964 | Sherburne | ..... | E04B 1/4107 52/701 |
| 4,052,833 | A * | 10/1977 | Beine | ..... | E04B 1/4107 52/710 |
| 2010/0170185 | A1* | 7/2010 | Birnbaum | ..... | E04B 1/4107 52/699 |

FOREIGN PATENT DOCUMENTS

| | | | | | |
|---|---|---|---|---|---|
| CH | 379734 | A * | 7/1964 | ..... | E04B 1/41 |
| DE | 9108942 | U1 * | 11/1992 | ..... | E04B 1/4107 |
| EP | 1029993 | A2 * | 8/2000 | ..... | E04B 1/4107 |
| EP | 1486629 | A2 * | 12/2004 | ..... | E04B 1/4107 |

* cited by examiner

*Primary Examiner* — Christine T Cajilig
(74) *Attorney, Agent, or Firm* — Mark M. Friedman

(57) ABSTRACT

The present invention relates to a profiled rail (2) for fastening to a formwork (5) for at least partially embedding in concrete. The profiled rail (2) is formed in a substantially C-shaped manner along a profiled rail longitudinal axis, wherein a plurality of holes (24) are formed in the rail back (21). Plugs (1) are inserted into some of the holes (24), wherein each plug (1) has a cap section (12) and an adjoining through section (10). The through section (10) fits through the respective hole wherein the cap section butts against the rail back (21). The plug (1) has a feed-through region (13) through which an elongate connecting element (4) can be pieced being guided by the feed-through region (13). The connecting element (4) is preferably a nail or a screw and connects the plug (1) to the formwork (5) holding the profiled rail on the formwork (5).

17 Claims, 6 Drawing Sheets

PROFILED RAIL WITH PLUG FOR FASTENING TO FORMWORK

The present invention relates to a profiled rail and fastening means for fastening the profiled rail to formwork to at least partially embed the profiled rail in concrete, and it relates to a respective method therefore.

Known profiled rails, which can also be referred to as anchor rails, profiled anchor rails or mounting rails for anchoring in concrete, are usually formed in a C-shaped manner along a profiled rail longitudinal axis, with a rail back and two lateral flanks each having angled wing sections, the wing sections each extending towards each other such that a rail slit with a rail slit width remains open therebetween. The rail slit has the characteristic that one or more screws can be inserted therein, in order to screw-fasten other parts to the profiled rail. Preferably, the screws can be mounted at any points along the rail slit and can transmit forces preferably perpendicular to the rail longitudinal axis. A particular embodiment has teeth on the inside of the wing sections so that forces can also be transmitted parallel to the profile longitudinal axis via the teeth. Multiple anchors, such as profiled anchors or round anchors, are preferably connected or can be connected to the rail back in order to effect better form-fitting anchoring of the profiled rail in the concrete when it is embedded in concrete. The term "concrete" also represents any other casting material, such as cement or concrete mixtures or construction material mixtures which are suitable for embedding the profiled rail.

Multiple holes are preferably made along a centre line of the rail back, through which holes the profiled rail can preferably be nailed to the formwork. Before the profiled rail is embedded in concrete, the profiled rail is temporarily connected to the formwork on the side with the rail slit such that the profiled rail sits with the rail slit tight against the formwork, which is flat, and is connected thereto. Generally, the profiled rail is attached to or on the formwork by nailing or screwing onto conventional wood or plastic formwork. The profiled rail is connected to the formwork by bolts or nails, which are driven into the formwork through the holes, or by screws which are screwed into the formwork or screwed through and fixed with a lock nut. The holes have a hole diameter or hole cross-section which fits the bolts, nails or screws. The arrangement of the anchors along the rail back must often be done in a customised way; the profiled rails, which are standardised profiled rails, must subsequently be individually modified and adjusted to the requirements of the individual construction plans, which takes time.

Alternatively, in a widespread design of the profiled rail, holes are made in the rail back at regular intervals, the diameter of which holes allows the nail shaft to pass through but not the nail head. These nail holes must be made in the rail back as part of the production process or in a separate step, e.g. by drilling or punching; this process is time- and cost-intensive.

DE 10 2007 040 279 A1 discloses different possibilities of connecting the profiled rail also with wire wrapped around it to the formwork, through which the two wire ends are guided, pulled and locked in front of the formwork to pull and hold the profiled rail against the formwork.

After the concrete has cured, shuttering side walls and the formwork which is connected to the profiled rail are removed, so that sides, intended for further fastening, of inlay parts embedded in concrete are exposed in a concrete surface. Thereafter the shuttering can be cleaned and reused in another location. A disadvantage in this case can be nail ends or screw ends which protrude from the profiled rail, which usually have to be ground off laboriously and at risk of injury or knocked off with the aid of a chisel. Only after such time-consuming work the profiled rail is available for use with suitable special screws (hammer head or hook bolts).

DE 20 2015 003 443 U1 discloses a profiled rail in which, in a profiled rail inner space which is formed between the flanks and the rail back, a respective holding element is connected to the profiled rail, against which holding element the formwork is pulled and locked via a screw connection. This method makes it unnecessary to grind off or bend the nail ends or screw ends, but is more expensive in terms of required material and installation.

DE 9 108 942 U1 discloses a profiled rail which is formed with a c-profiled cross-sectional shape with holes provided in the rail back, through which holding nails can be hammered up to the respective formwork board on which the rail is located. In a gap opening opposite tp the holes there are provided filler strips in order to close the gap opening. After a completed embedding pouring of the rail, in a subsequent step after the formwork board has been pulled off, the protruding holding nails for example have to be overturned or tweaked, wherein still ends of the holding nails are present and visible.

CH 379 734 A discloses the profiled rail with holes and holding nails provided in the rail back, which are adapted to that a retaining nail head is screwed onto a respective holding nail shaft by a thread. With the screwed on holding nail head, the holding nail can first be hammered into the formwork board. After a completed embedded pouring of the rail, in a subsequent step the formwork panel can be pulled off, and the protruding holding nails can be easily bent or can be turned out. The disadvantage here is that the thread in holding nail is often damaged when the holding nail is hammered into the forming board and the subsequent removal of the nail shaft is made even more difficult.

EP 1 486 629 A2 discloses a similar threaded retaining nail such as CH 379 734 A with the same advantages and disadvantages.

Suitable special screws/screw-fastenings which are inserted into the profiled rail and guided through the rail slit are selected using planning and approval documents according to the profiled rail size and type of use (pull force, transverse pull force etc.). A user generally identifies the profiled rail using a marking or stamp on the inside of the rail.

DE 29 903 167 discloses that a stamp can also be part of an anchor. Or the stamp can be included as a separate process within the manufacturing procedure. Both techniques are cost-intensive. Alternatively, labels are applied, the weather-resistance of which is often doubted by users.

Profiled rails are required and produced in different lengths depending on their use, generally between 100 mm and 6 m. DE 19 907 475 discloses a method in which anchors are guided through anchor holes in depressions in the rail back of a profiled rail and fastened captively by material deformation. These anchor holes are generally produced by means of a punching and stamping die at the same time as the holes for the nails or screws and the respective depressions are produced. After the anchors have been inserted and fastened, corrosion protection can be applied. It is known from EP 2 388 382 that plugs can be used in the holes for the nails or screws to protect an unprotected surface in the hole region from corrosion by closing it. However, this does not solve the problem of the lack of corrosion protection for the larger anchor holes in which an anchor is held. Therefore, it is generally customary to apply the corrosion protection only after all the work which can damage the surface. Subsequent setting of an additional anchor is generally not provided for.

The currently customary concatenation of the manufacturing processes including the corrosion protection measures requires complex and expensive logistics.

The present invention is based on the object of overcoming the disadvantages of the prior art and providing a profiled rail which can be connected via connecting means to formwork for concrete casting in the simplest and most time- and cost-saving manner possible and from which the formwork can be detached again, including any protruding connecting means, and a respective method for achieving this shall be provided.

The above object is achieved by a profiled rail for fastening to a formwork for at least partially embedding in concrete according to the features of independent claim 1 and by a method for fastening the profiled rail to the formwork according to the features of independent claim 12. Further advantageous embodiments of the invention are specified in the dependent claims.

According to the invention, a profiled rail for fastening to a formwork for at least partially embedding in concrete is provided, wherein

- the profiled rail is formed in a substantially C-shaped manner along a profiled rail longitudinal axis by a rail back with two opposing flanks which protrude at an angle laterally therefrom, wherein the flanks each have at their edges opposing the rail back wing sections angled towards each other, wherein each wing section has an outer edge which is connected to the respective flank and an inner edge, so that the two inner edges which run towards each other form a parallel rail slit and the two wing sections form a bottom plane to bear against the formwork by the bottom plane,
- wherein a first number of holes, each having a hole cross-section, are formed in the rail back;
- a second number of plugs are inserted into the first number of holes in a distributed manner,
- wherein each plug has, along a central plug longitudinal axis, a cap section and an adjoining through section, wherein the cap section has a first end face and a first outer cross-section which is greater than the hole cross-section, so that when the through section is inserted into the respective hole the cap section butts against the rail back and is retained, wherein the through section has a second end face which is opposite the first end face and has a second outer cross-section which can be fed through the respective hole or pressed therein until the cap section butts against the rail back;
- wherein each plug has, in the direction of the plug longitudinal axis, a feed-through region for an elongate connecting element, said feed-through region being adapted to be manually pierceable by the connecting element and to guide the connecting element;
- wherein the connecting element is in the form of a nail or a screw having a head and a shaft with a length which is sufficient to connect the plug to the formwork with the profiled rail therebetween.

A particular advantage of the present invention is the provision of the plugs between the profiled rail and the connecting element, since the plugs can be inserted and removed again at any locations prefabricated in the profiled rail to produce a connection between the profiled rail and the formwork via a respective connecting element at the locations with the respective plugs. The connecting element has no direct contact with the profiled rail and does not damage it or any corrosion protection on the profiled rail, which is preferably corrosion-protected overall together with the prefabricated holes. The plug is preferably a plastic plug, which has the further advantages that it, since it is preferably elastic, can be inserted easily into the profiled rail, preferably has a sealing effect and is cost-effective. In comparison with the connecting element, such as a nail, the plug has a larger outer cross-section and correspondingly a lower surface pressure against the profiled rail at a same compressive force.

Preferably, the prefabricated holes are adapted such that both a plug and an anchor can be inserted therein, so that the corresponding selection can be made directly on the construction site. This also saves a lot of time and cost or complex and much more costly pre-planning.

Preferably, the plug is designed such that, when it sits in the profiled rail and the connecting element is connected to the formwork to mount the profiled rail on the formwork, the plug is pulled through the rail slit towards the formwork by the connecting element, up to a first pulling force, and the plug holds the connecting element. In addition, the plug is preferably designed such that, after the formwork has subsequently been removed, the plug releases the connecting element in the direction from the plug to the rail slit, at a second pulling force or higher, and allows it to slip through or break out. The second pulling force is preferably higher than the first pulling force. Preferably, the plug is sufficiently elastic for the connecting element, at least in the feed-through region, or has a predetermined pull linkage so that the connecting element can be pulled out of the hole of the profiled rail through the rail slit with the second pulling force or higher. Preferably, the predetermined pull linkage breaks when a material of the plug can be pulled out in the region of the predetermined pull linkage to form the predetermined pull linkage by means of a thinning of the material. For example, the material which is to be pulled out can be provided with a tab which is arranged on the side of the feed-through region and is accessible from the rail slit when the plug is mounted in the profiled rail.

When a marking or identifier which is relevant for the profiled rail is preferably applied to the plug, preferably on the first end face and/or on the opposite second end face, this important marking for the profiled rail, which must also be recognizable at all times subsequently when embedded in concrete, does not have to be stamped or engraved into the profiled rail itself, at much greater effort. Stamping or engraving the marking into the profiled rail itself is problematic for the application of corrosion protection if the corrosion protection is partially milled off or removed or if an anti-corrosion layer is applied subsequently, making the marking difficult to read. Applied paint can also easily be scratched off during construction work; these problems do not occur if the plug is imprinted.

Preferred embodiments according to the present invention are presented in the drawings below and in a detailed description, but they are not intended to limit the present invention exclusively thereto.

In the figures,

FIG. 1 shows a perspective view of a detail of a first embodiment of a profiled rail which is formed in a C-shaped manner along a profiled rail longitudinal axis, with a rail back, two lateral flanks and two wing sections on the lower sides thereof which are angled towards each other and form a rail slit therebetween, and which has in a rail back holes into which preferably anchors or plugs (not shown) can be inserted;

FIG. 2 shows a perspective view of a detail of the first embodiment of the profiled rail of FIG. 1 which has three anchors at the top, which are profiled anchors and are connected to the profiled rail, the plugs being inserted between the anchors; a connecting element in the form of a nail is partially inserted into two of the plugs, in each case in a feed-through region;

FIG. 3 shows a perspective view of a detail of a second embodiment of the profiled rail which is C-shaped along the profiled rail longitudinal axis and having at the side towards the top two anchors, which are round anchors and are connected to the profiled rail, the plugs being arranged between the anchors, and wherein in one of the plugs the nail is partially inserted in the feed-through region thereof;

Figure 4:
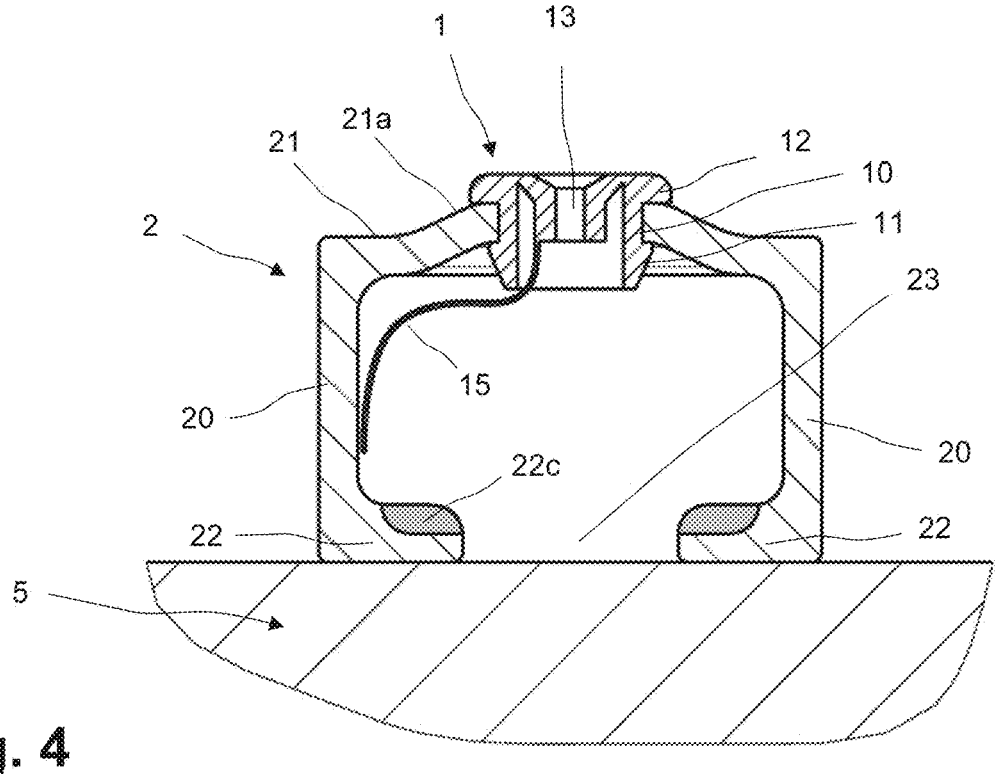
FIG. 4 shows a side sectional view in the direction of the profile longitudinal axis of the profiled rail of FIG. 3 with a plug inserted therein, cut along a common sectional plane and inserted into the hole, the profiled rail being laid on the formwork.
Figure 5:
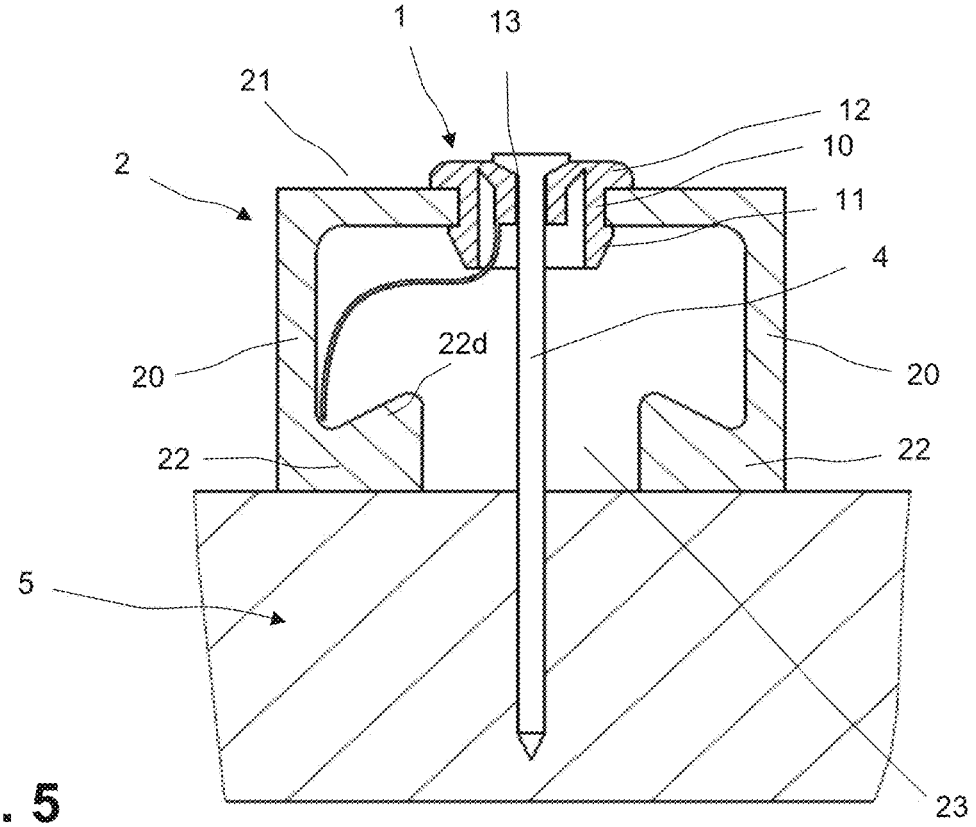
FIG. 5 shows a side sectional view in the direction of the profile longitudinal axis of the profiled rail of FIG. 1 with a plug inserted therein, cut along the sectional plane and inserted into the hole, the profiled rail being laid on the formwork and connected to the formwork with the nail between the plug and the formwork.
Figure 8:
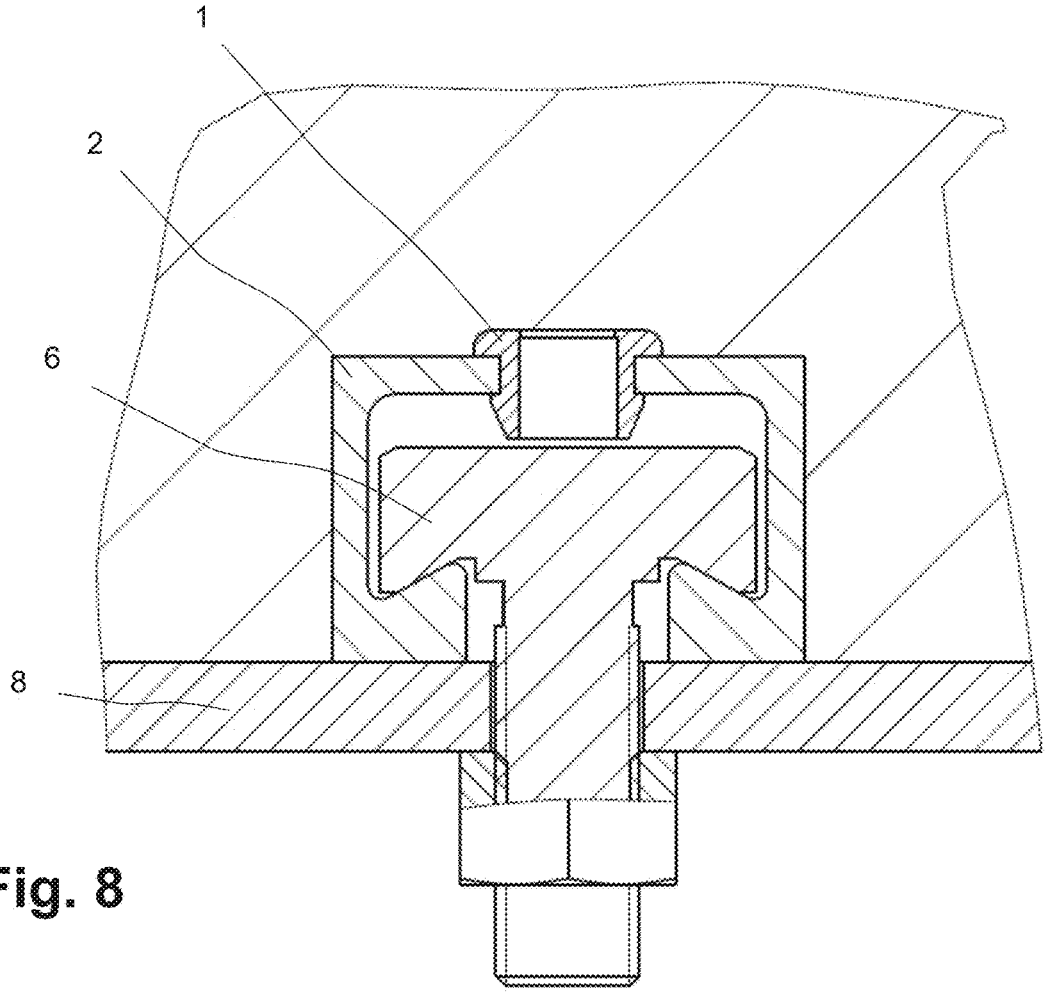
Figure 9:
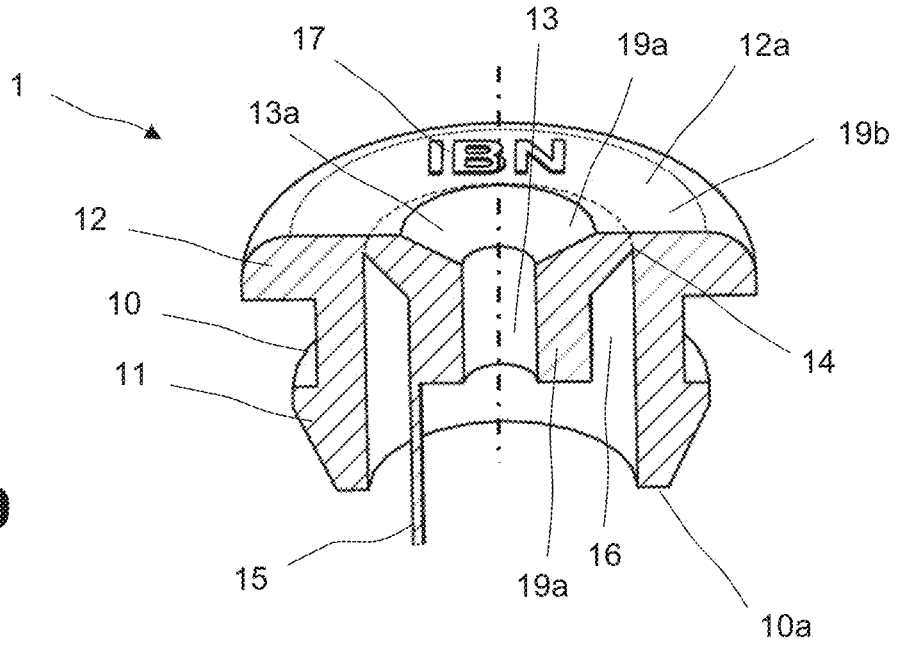
Figure 10:
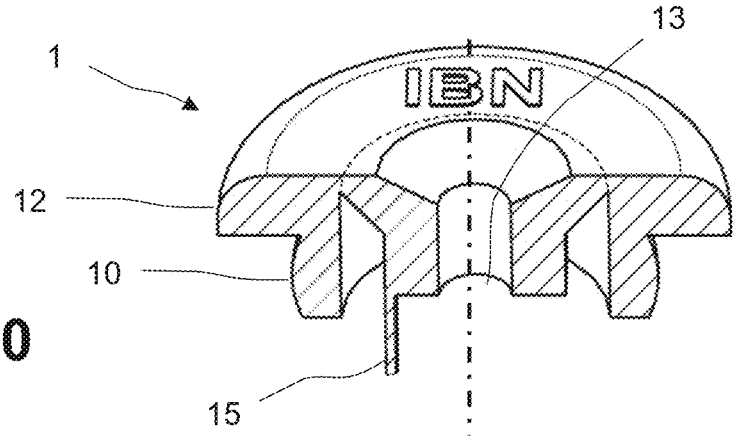
Figure 11:
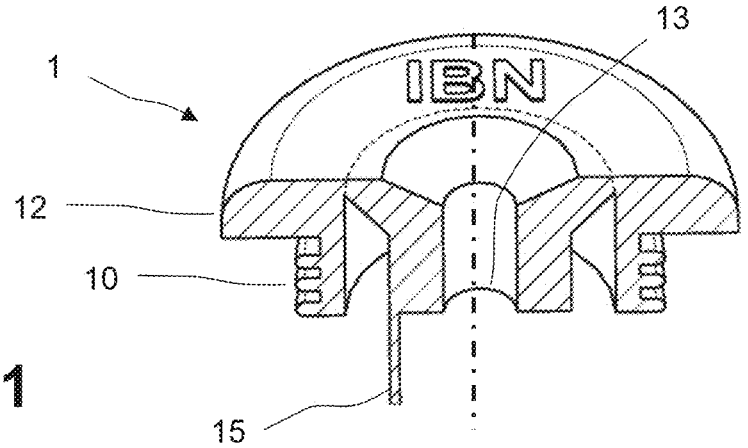
Figure 12:
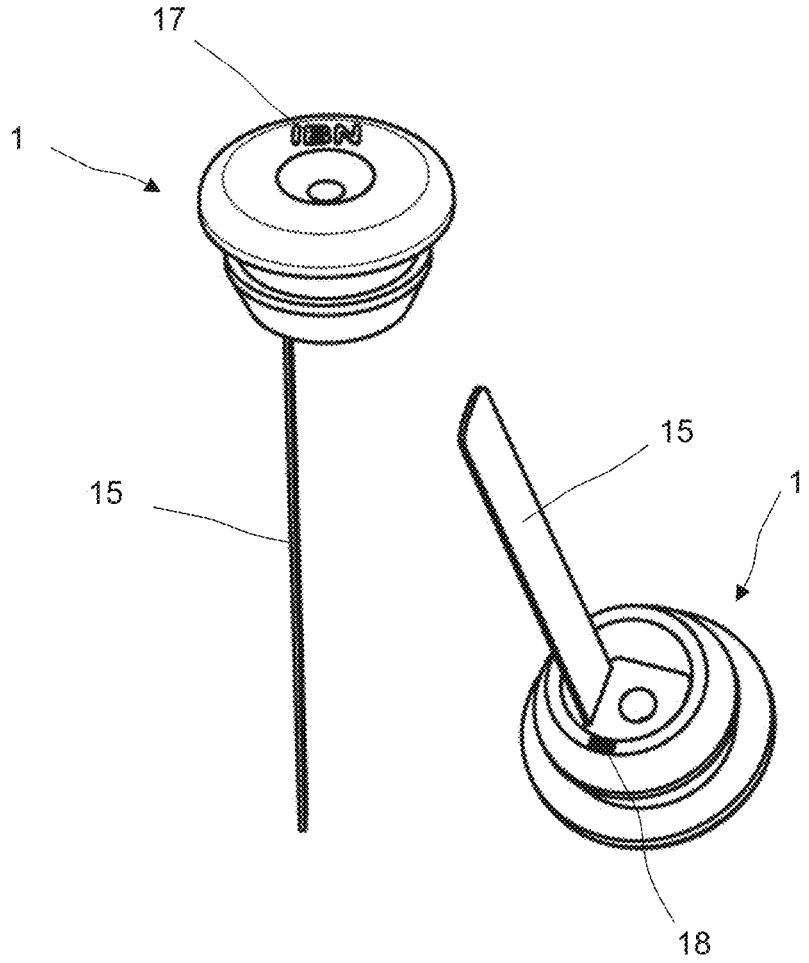

FIG. 8 shows a side sectional view in the direction of the profile longitudinal axis of the profiled rail of FIG. 5 with a different plug inserted therein, cut along the sectional plane and inserted into the hole, an inner section of the plug with the nail no longer being present, and a profiled screw with a screw head being inserted into the profiled rail and protruding through the rail slit with a threaded part to which a board is screw-fastened;

FIG. 9 shows a side sectional view of the plug in a first embodiment, as also shown for example in FIGS. 4 and 5, the plug having a cap section and a through section with a latching shoulder; a plug longitudinal axis is indicated with a dash-dotted line;

FIG. 10 shows a side sectional view of the plug in a second embodiment which has the cap section and the through section, the through section being convex on the outside about a plug longitudinal axis in order to be able to wedge better in the respective hole;

FIG. 11 shows a side sectional view of the plug in a third embodiment which has the cap section and the through section, the through section having annular ribs on the outside about the plug longitudinal axis in order to be able to wedge better in the respective hole;

FIG. 12 shows on the left side of the image a first perspective view from above and from one side the plug of the first embodiment of FIG. 9 which bears a first marking on an upper, outer, first end face; and on the right side of the image a second perspective view from below and from the side the plug of the first embodiment of FIG. 9 which bears a second marking on a lower, inner, second end face.

DETAILED DESCRIPTION OF EXEMPLARY EMBODIMENTS

Figure 1:
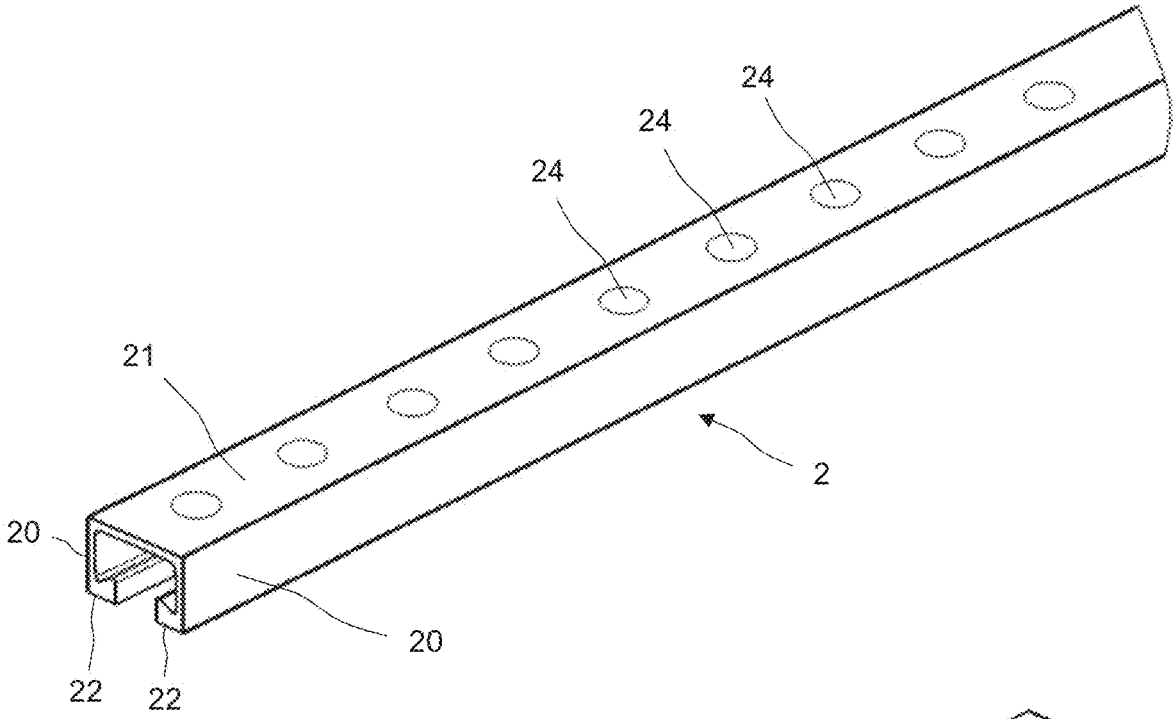
Figure 2:
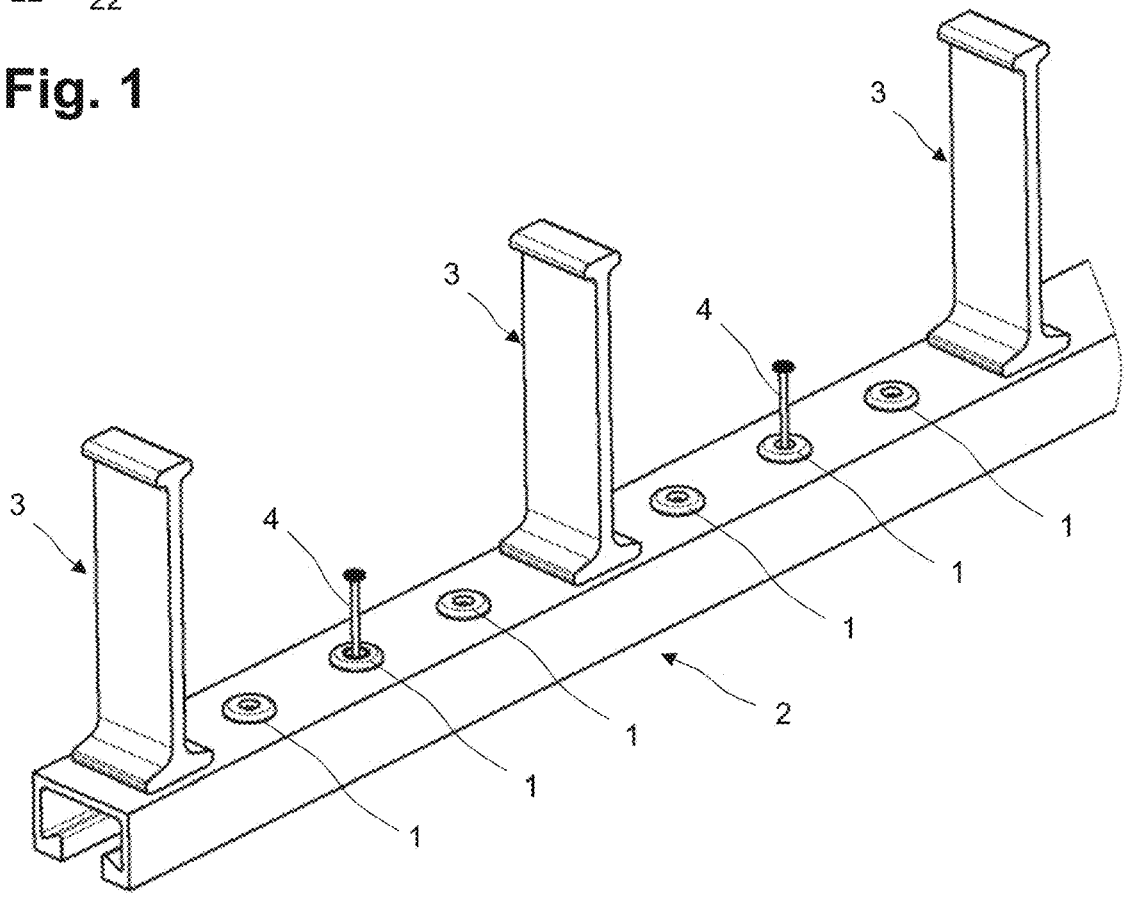
Figure 3:
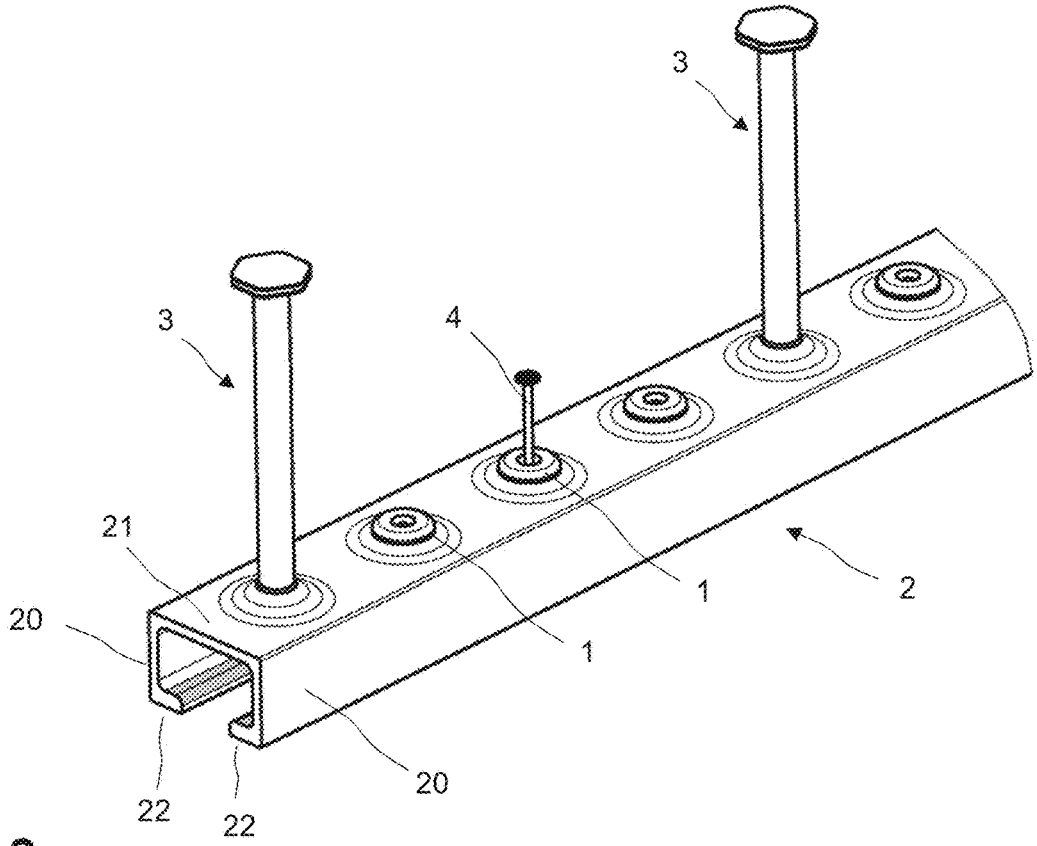

FIG. 1 shows a profiled rail 2 of a preferred embodiment which is intended to be at least partially embedded in concrete, as mentioned at the beginning. Preferably, such a profiled rail 2, which is also referred to as an anchor rail or mounting rail, is provided with one or more anchors 3 or is already provided with the anchors 3 which are fixedly connected to the profiled rail 2 in order to effect better retention of the profiled rail 2 in the concrete. FIG. 2 and FIG. 3 show such profiled rails 2 which are provide with anchors 3 which, in a subsequent state in which the concrete is cast around the profiled rail 2, arrest or "anchor" the profiled rail 2 fixedly therein. As already mentioned in the introduction, in practice, the profiled rail 2 is first fastened to the formwork 5 with connecting elements 4 so that the concrete can then be cast around it. Afterwards the formwork 5 is removed again so that a rail slit of the profiled rail 2 becomes visible. The profiled rail 2 is substantially C-shaped along a profiled rail longitudinal axis having a rail back 21 and two opposing flanks 20 which protrude laterally at an angle therefrom, the flanks 20 each having, at their edges opposite the rail back 21, wing sections 22 angled towards each other. Each wing section 22 has an outer edge 22*a*, which is connected to the respective flank 20, and an inner edge 22*b* which is opposite and preferably parallel thereto, each wing section 22 being angled or bent from the flank 20 connected thereto such that the two inner edges 22*b*, running towards each other, of the two wing sections 22 form a parallel rail slit 23. At the same time, the two wing sections 22 form a lowest bottom plane opposite the rail back, the lowest bottom plane being intended to bear against the formwork 5. Between the flanks 20 and the rail back 21 and the wing sections 22 a profiled rail inner space is formed which is intended to remain free from concrete as far as possible when the concrete is cast around the profiled rail 2, so that at least one profiled rail screw 6 can preferably be inserted later in order to be able to connect, for example, a board 8 to the profiled rail 2 by means of the profiled rail screw 6, as shown in FIG. 8. Besides, in FIG. 8 the connecting element 4 has already been pulled out or broken out after the concrete has been cast around the profiled rail 2; said concrete is indicated by the wide stripes.

The rail back 21 has a first number of holes 24 with a hole cross-section into some of which a second number of plugs 1 are inserted, according to the invention. Preferably, the holes 24 are arranged along a centre line of the rail back 21. Alternatively, the holes 24 can also be arranged differently in the rail back 21. An additional arrangement of further identical holes 24 laterally in one or both flanks 20 is also conceivable.

Each plug 1 has, along a central plug longitudinal axis, a cap section 12 and an adjoining through section 10, which are connected integrally to each other. FIG. 9-FIG. 11 show embodiments of the plug 1. The cap section 12 has a first end face 12*a* with a first outer cross-section which is larger than the hole cross-section so that when the through section 10 is inserted into the respective hole 24 the cap section 12 butts against the rail back 21 and is retained. The cap section 12 is preferably designed such that at least its outer edge section running around the plug longitudinal axis cannot be pulled through the hole 24 even with application of force. The through section 10 has a second end face 10*a* which is opposite the first end face 12*a* and has a second outer cross-section which can be fed through or pressed into the respective hole 24 on insertion until the cap section 12 butts against the rail back 21. The plug 1 has in the direction of the plug longitudinal axis a feed-through region 13 through which an elongate connecting element 4 can be manually fed or pierced or screwed. The feed-through region 13 is designed to guide the connecting element 4 in the direction of the plug longitudinal axis. Preferably, the feed-through region 13 is arranged centrally along the plug longitudinal axis. Preferably, the connecting element 4 is a nail or a screw or a bolt and has a head and a shaft. The head of the connecting element 4 is at least so wide and the feed-through region 13 is so narrow that the head is retained by the plug 1, preferably stopped and does not slip through the feed-through region 13 when the profiled rail 2 is mounted on or fastened to the formwork 5. The shaft of the connecting element 4 has a length which is sufficient to be connected to the formwork 5. In other words, if a nail or a screw is used as the connecting element 4, the nail or the screw must preferably extend into or through the formwork 5 in order to be able to produce a sufficiently firm connection. Also conceivable is, of course, a plug-in nut through the formwork, which means that the screw does not have to extend entirely to the formwork 5, and the like. It is also conceivable for the plug 1 to be formed preferably with two or more feed-through regions 13, through which then preferably in each case one connecting element 4 can be driven towards the formwork 5. In this manner, the retention between the plug 1 and the formwork 5 can be increased. Each feed-through region 13 in the plug 1 can be designed for example as a hole or as a blind hole with a cover wall which can be pierced or as a region with a cylindrical cavity along a feed-through axis for the connecting element 4. The hollow region can also be formed with a softer material or a material with thinner walls. The feed-through region 13 can also be formed by a thinning of the material in the cap section 12 or in the through section 10. During mounting, respective connecting elements 4 are fed, screwed or pierced through the plugs 1, which are inserted into the profiled rail 2, and connected to the formwork so that the profiled rail 2 bears firmly and is held against the formwork 5. The connecting elements 4 are driven through the respective plug 1 towards the formwork so far that a first pulling force acts along the plug longitudinal axis on the respective plug 1 towards the formwork 5. The profiled rail 2 is thereby connected to the formwork 5 between the plug 1 and the formwork 5 at the respective location of the connecting element 4 up to the first pulling force.

Preferably, the respective connecting element 4 can then be pulled through the respective plug 1 or through the hole 24 by its shaft in the direction from the plug to the rail slit 23 with at least a second pulling force which is preferably higher than the first pulling force. Preferably, the first pulling force is effective along the plug longitudinal axis from the cap section 12 to the rail slit 23. For clarity, the first pulling force of the shaft of the connecting element 4 acts on the plug 1 in the direction towards the formwork 5 after the profiled rail 2 is mounted on the formwork 5.

Preferably, each plug 1 has, around the plug longitudinal axis, a predetermined pull linkage 14 which is formed between an inner section 19*a* with the feed-through region 13 and an outer section 19*b* which remains around the plug longitudinal axis, around the outside of the inner section 19*a*. FIG. 9, FIG. 10 and FIG. 11 show preferred embodiments of the predetermined pull linkages 14 marked by dashed lines. The inner section 19*a* has a cross-section which is smaller than the hole cross-section so that it can be pulled through the hole 24 together with the connecting element 4 when the predetermined pull linkage 14 breaks. Preferably, the predetermined pull linkage 14 breaks at the second pulling force or higher of the connecting element 4 in the direction from the plug 1 to the rail slit 23. Preferably, the predetermined pull linkage 14 is formed by an annular thinning of the material wall around the plug longitudinal axis. Preferably, the predetermined pull linkage 14 is designed to hold and not tear up to the first pulling force of the connecting element 4 on the plug 1 in the direction of the formwork 5. For clarity, the direction statement "towards the formwork" means from the plug 1 towards the rail slit 23. A gravitational force or a pivoting moment can preferably also aid breaking of the predetermined pull linkage, and therefore the second pulling force can also be preferably smaller than the first pulling force. The profiled rail 2 is thereby pulled against the formwork by means of the respective connecting element 4 and the plug at the location of the respective connecting element 4 with up to the first pulling force. Preferably, the predetermined pull linkage 14 is designed to tear at least at the second pulling force of the connecting element 4 on the plug 1 in the direction towards the rail slit 23 so that the respective connecting element 4 can be pulled out of the plug with the second pulling force.

Preferably, the annular thinning of the material wall is formed by a material which can be pulled out of a region of the predetermined pull linkage 14 and is connected to a pulling tab 15. When the plug 1 is mounted in the profiled rail 2, the pulling tab 15 is preferably located on the side of the through region 10 and is accessible from the rail slit 23. The pulling tab 15 is shown by way of example in FIGS. 4, 5 and 9-12.

Preferably, each plug 1 is so elastic in the feed-through region 13 that, when the profiled rail 2 is mounted on the formwork 5, the connecting element 4 is held by the head in the feed-through region 13 of the plug 1 up to the first pulling force, in order to hold the profiled rail 2 on the formwork 5 at the location of the connecting element 4 up to the first pulling force. The feed-through region 13 yields in a region of the head of the connecting element 4 in the direction towards the rail slit 23 at least at the second pulling force, so that the connecting element 4 is pulled by the head through the feed-through region 13. The second pulling force is preferably greater than the first pulling force. However, the plug 1 can also be designed to yield faster to the head of the connecting element 4 after a pivoting movement or a pivoting force with which the connecting element is, for example, pivoted or tilted along the rail slit 23, in which case the second pulling force can be smaller than the first pulling force.

For clarity, it is self-evident that the pulling forces of each connecting element 4 towards the formwork 5 add up and form a correspondingly greater total force with which the profiled rail 2 is pulled towards the formwork 5.

Preferably, the predetermined pull linkage 14 can be designed to break as a result of a torsional movement upwards of a predetermined torsional moment. Preferably, the predetermined pull linkage 14 can be designed to break in particular as a result of a pivoting movement at least at of a predetermined pivoting moment or a predetermined pivoting force.

Alternatively designed predetermined pull linkages 14 or elastic regions which hold the connecting element 4 in the plug 1 up to the first pulling force and release it or allow it to break out at least at the second pulling force can also be in the form of, for example, slits, cross-slits or others.

Figure 6:
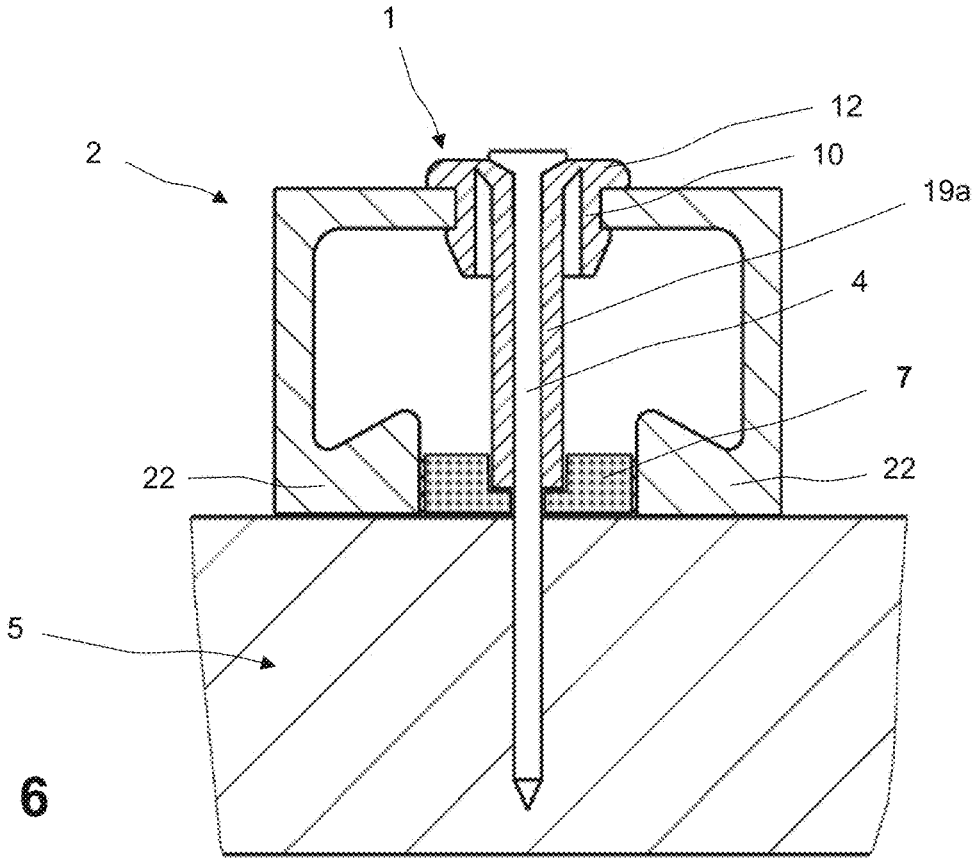
FIG. 6 shows a side sectional view in the direction of the profile longitudinal axis of the profiled rail of FIG. 1 with a different plug inserted therein, cut along the sectional plane and inserted into the hole, the profiled rail having a sealing profile pressed into the rail slit, being laid on formwork and being connected to the formwork with the nail between the plug and the formwork.

Preferably, the profiled rail 2 also comprises a sealing profile 7, as shown by way of example in FIG. 6, which is formed along the profiled rail longitudinal axis with a sealing profile cross-section and an elasticity such that it can be pressed with the sealing profile cross-section into the rail slit 23, which has a rail slit width, and can thus seal said rail slit towards a profiled rail inner space. By means of the sealing profile 7, the profiled rail inner space is protected and sealed off from lateral and lower ingress of the concrete when the concrete is cast around the profiled rail 2. Preferably, the plug 1 has such a length that the second end face 10*a* of the through section 10 extends at least to the sealing profile 7 which is inserted in the profiled rail 2, as a result of which the sealing profile 7 is supported towards the profiled rail inner space.

Preferably, the sealing profile 7, as shown by way of example in FIG. 6, has a groove or a plurality of cup-like cut-outs, having a groove depth or cup depth and a groove cross-section or cup cross-section perpendicular thereto, in the direction towards the profiled rail inner space. The groove depth or cup depth is smaller than the height of the sealing profile 7, and the groove cross-section or cup cross-section is so much smaller than the lower outer cross-section of the through section 10 at the second end face 10*a* that the through section 10 can be inserted, pressed and/or latched by the lower outer cross-section into the cup cross-section. Preferably, the groove depth, the groove cross-section and the through section 10 are designed such that the through section 10 can be pressed by the lower outer cross-section into the groove cross-section and holds the sealing profile 7 by means of friction. Alternatively, the cup depth, the cup cross-section and the through section 10 are preferably designed such that the through section 10 can be pressed by the lower outer cross-section into the cup cross-section and holds the sealing profile 7 by means of friction. Preferably, the lower outer cross-section of the through section 10 which fits into the groove or into the respective cup-like cut-out is part of the inner section 19*a* of the predetermined pull linkage 14 which can be broken out of the cap section 12 of the plug 1.

Preferably, the plug 1 has a first marking 17 on the first end face 12*a* and, alternatively or additionally, a second marking 18 on the second end face 10*a*, as shown in FIG. 12. The respective first marking 17 and/or second marking 18 preferably comprises an identification code for the profiled rail 2. Advantageously, the second marking 18 is arranged on a lower face of the plug 1 such that the second marking can be recognised through the rail slit 23 from below when inserted in the profiled rail 2 and can even be recognised after the profiled rail 2 is embedded and the formwork 5 is removed.

Preferably, the holes 24 in the profiled rail 2 have the same hole cross-section for the plug 1 as for the anchors 3, for example the profiled or round anchors, which can be inserted therein. In other words, the holes 24 which fit the plugs 1 are preferably the same as anchor holes into which the anchors 3 can be inserted. In this case, a respective anchor 3 can be inserted and connected through the respective hole 24 to the profiled rail 2, for example by a screw-fastening or welding. In this case it is also particularly advantageous that the profiled rail 2 can be produced as a standard model in relatively large quantities and then simply be adapted to an individual construction without any additional specific zinc plating or the like being required.

Preferably, each plug 1 is designed, when mounted in the profiled rail 2, to be detachable and removable again from the profiled rail 2, so that the anchor 3 can be inserted into a hole 24 from which the respective plug 1 has been removed, and preferably vice versa.

Preferably, the plug 1 has a concave cut-out 13*a* around the plug longitudinal axis in a region of the cap section 12 and around the feed-through region 13, said concave cut-out being designed such that the head of the connecting element 4 can sink completely therein along the plug longitudinal axis, as shown in FIG. 9-FIG. 11, in which the plug longitudinal axis is shown with a dash-dotted line.

Preferably, the rail back 21 is curved convexly outwards in each hole 24 region, so that outwardly convex depressions 21*a* or wells are formed therein, as shown in FIG. 3 and FIG. 4.

Figure 7:
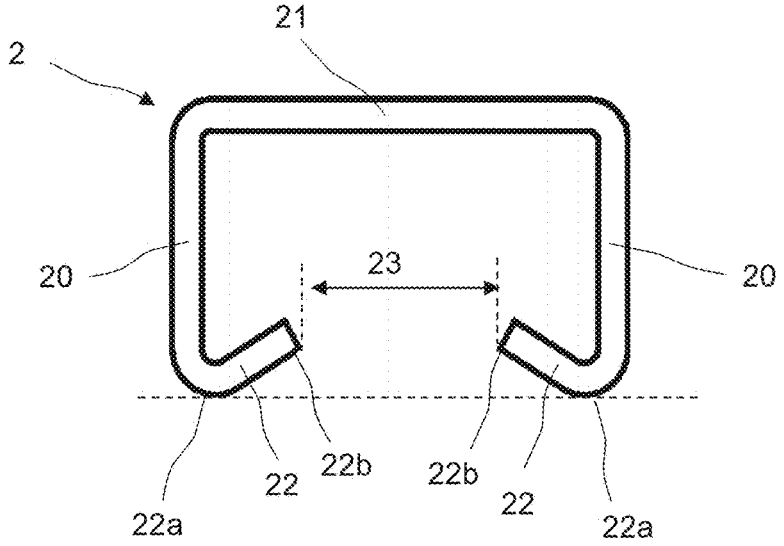
FIG. 7 shows a side view in the direction of the profile longitudinal axis of a further embodiment of the profiled rail, the two lower wing sections angled towards each other running upwards and inwards from a lower outer edge to an inner edge, the respective flanks being at an acute angle to the respective wing sections.

Preferably, the profiled rail 2 is an anchor rail or profiled anchor rail. FIG. 7 shows a preferred embodiment of the profiled rail 2, in which the wing sections 22 are each angled or bent at an acute angle to the flanks 20.

Preferably, the first number of holes 24 is greater than or equal to the second number of plugs 1.

Preferably, the hole cross-section of the holes 24 and the through section 10 of the plug 1 are designed such that the through section 10 is elastic and wider than the hole cross-section in a wedging region which is close or adjacent to the cap section 12 to such an extent that the plug can be pressed into the hole 24 with the through section 10 first as far as the cap section 12, and wedges therein and can detached and removed therefrom manually.

Preferably, the feed-through region 13 of the plug 1 is substantially leakproof to liquid concrete when in the state before the connecting element 4 has pierced through.

Preferably, the through section 10 of the plug 1 is formed with a latching shoulder 11, as shown by way of example in FIG. 9 and in FIG. 4-FIG. 6, which is designed and arranged such that, when the plug 1 is mounted in the profiled rail 2, said latching shoulder presses against the profiled rail 2 from a rear face and prevents the plug 1 from being pulled out of the profiled rail 2 up to a predetermined pulling force.

Alternatively, the through section 10 of the plug 1, as shown by way of example in FIG. 10, is preferably outwardly convex along the plug longitudinal axis in the mounted state in a region of the profiled rail 2, in order to allow pressing into the hole 24 and wedging better than would be possible if the through section 10 were cylindrical in the region of the profiled rail 2. Alternatively, the through section 10 of the plug 1 can preferably, as shown by way of example in FIG. 11, have ribs along the plug longitudinal axis in the region of the profiled rail 2.

Preferably, the through section 10 of the plug 1 is formed with a thread which is designed and arranged such that, when the plug is mounted in the profiled rail 2, said thread can be locked against the profiled rail 2 from behind in the profiled rail inner space by means of a nut.

Preferably, the plug 1 is formed from a plastic material, and the plastic material is elastic, with a Shore hardness of preferably 30-60 or further preferably 60-80 or even more preferably 80-100. Alternatively, the plug 1 preferably consists of a metal.

Preferably, the plugs consist of a plastic, such as polyamide, polystyrene, polyethylene, polypropylene, PVC, or a similar thermoplastic or a duromer or an elastomer or they comprise such a plastic or a mixture thereof. Preferably, the plug has an insert part in the feed-through region 13 or in the cap region, for example an insert part consisting of a metal or a harder plastic than the rest of the plug.

Preferably, a head diameter of the connecting elements 4 is smaller than the hole cross-section of the holes 24, so that the head of the connecting element 4 can be pulled through the respective hole 24 at least at the second pulling force.

Preferably, the profiled rail 2 consists of steel, iron, cast iron or another hard metal having a hardness at least equal to iron.

Preferably, the wing sections 22 are smooth towards the profiled rail inner space, as shown by way of example in FIG. 1, 2, 5, 6, 7 or 8. Alternatively, the wing sections 22 have teeth 22*c* towards the profiled rail inner space along the profiled rail longitudinal axis, which teeth allow the profiled rail screw 6, which has corresponding, complementary teeth, to be secured against slipping in the profiled rail 2.

Preferably, the wing sections 22 are formed with substantially the same thickness towards the rail slit 23, as shown by way of example in FIG. 3, FIG. 4 and FIG. 7. Alternatively, the wing sections 22 are preferably formed with an increasing thickness towards the rail slit 23, which forms a shoulder 22*d*, as shown by way of example in FIGS. 1, 2, 5, 6 and 8. For clarity, the wing sections 22 are also known as profile lips or rail lips.

Preferably, the formwork 5 consists of wood or a plastic or a metal.

A preferred method for mounting the profiled rail 2 on the formwork 5, for casting with concrete, and for subsequent removal by pulling the formwork 5 off the profiled rail 2, is as follows:

a) providing the profiled rail 2, which is formed in a substantially C-shaped manner along a profiled rail longitudinal axis with the rail back 21 with the two opposing flanks 20 which protrude at an angle laterally therefrom, wherein the flanks 20 each have at edges opposing the rail back 21 the respective wing sections 22 angled towards each other, wherein each wing section 22 has the outer edge 22*a* which is connected to the respective flank 20 and the inner edge 22*b*, so that the two inner edges 22*b* which run towards each other form a parallel rail slit 23 and the two wing sections 22 form the lowest bottom plane to bear against the formwork 5 by the lowest bottom plane, wherein the first number of holes 24, each having a hole cross-section, is formed in the rail back 21;

b) inserting the second number of plugs 1 into the holes 24, wherein each plug 1 has, along the central plug longitudinal axis, the cap section 12 and the adjoining through section 10, wherein the cap section 12 has the first end face 12*a* and the first outer cross-section which is greater than the hole cross-section so that the cap section 12 butts against the rail back 21 and is retained when the through section 10 is inserted into the respective hole 24, wherein the through section 10 has the second end face 10*a* which is opposite the first end face 12*a* and has the second outer cross-section which can be fed through the respective hole 24 or pressed therein until the cap section 12 butts against the rail back 21; wherein each plug 1 has, along the plug longitudinal axis, the feed-through region 13 for the respective elongate connecting element 4, said feed-through region being designed to be manually pierceable by the connecting element 4 guiding the connecting element 4;

c) placing the profiled rail 2 with the lowest bottom plane on the formwork 5;

d) inserting the connecting element 4, which extends from the rail back at least to the formwork 5, through the feed-through region 13 into the plug 1 up to the formwork 5 and connecting the profiled rail 2 to the formwork 5 by e) embedding the profiled rail 2 up to the formwork 5 in concrete or cement and waiting until the concrete or cement has solidified;

f) pulling the formwork 5 off the profiled rail 2; and g) pulling the connecting elements 4 out of the profiled rail 2 through the rail slit 23 with the second pulling force, h) by pulling with the second pulling force:

either deforming and opening the plug 1 around the feed-through region 13 so far that the head of the connecting element 4 is pulled through the plug 1, or by breaking the predetermined pull linkage 14 between the inner region 19*a* having the connecting element 4 and the outer region 19*b* of the through section 10 of the plug 1 around it, wherein the inner region 19*a* together with the connecting element 4 is pulled out of the rail slit 23.

Preferably, the profiled rail 2 is connected to the formwork 5 by hammering in a nail or screwing in a screw, as the respective connecting element 4, through the feed-through region 13 of the plug into the formwork 5. Alternatively, the profiled rail 2 is preferably connected to the formwork 5 by welding a bolt, as the connecting element 4, to a metallic shuttering surface of the formwork 5.

For clarity, the features "top" and "bottom" in this description mean relative location information in the vertical direction as shown in the figures. The same applies to the location information "right" and "left".

It is noted for clarity that herein an anchor generally means a profiled anchor, a round anchor or else another anchor which is suitable and known for being embedded in concrete in connection with the profiled rail, unless explicitly specified otherwise.

It is noted for clarity that herein the feature "concrete" generally can mean any substance, such as concrete, cement or another casting material which is known in construction for embedding profiled rails in formwork.

It is noted for clarity that herein the profiled rail also means an anchor rail, a profiled anchor rail or the like, which are synonyms for the profiled rail and are correspondingly known in construction for embedding in concrete and on formwork. The profiled rail can, for example, bear anchors or be provided with anchors at a later point.

It is noted for the sake of clarity that indefinite articles in conjunction with an object or number information, such as "one", do not limit an object to one object but mean that at least "one" object is meant, for example, there can also be a second or more such objects. This applies to all indefinite articles such as "a", "an" etc.

Further possible embodiments are described in the claims below. In particular, the different features of the above-described embodiments can also be combined with one another as long as they do not exclude one another technically.

The reference signs indicated in the claims are used only for better understanding and do not limit the claims in any way to the forms shown in the figures.

LIST OF REFERENCE SYMBOLS

1 Plug, also referred to as nail plug or screw plug
10 Through section
10*a* Second end face
11 Latching shoulder
12 Cap section
12*a* First end face
13 Feed-through region
13*a* Concave cut-out

14 Predetermined pull linkage
15 Pulling tab
16 Separating cut-out
17 First marking
18 Second marking
19*a* Inner section
19*b* Outer section
2 Profiled rail, synonym: anchor rail, profiled anchor rail, mounting rail
20 Flank
21 Rail back
21*a* Depression or well
22 Wing section
22*a* Outer edge
22*b* Inner edge
22*c* Teeth
22*d* Shoulder
23 Rail slit
24 Hole
3 Anchor, such as round anchor or profiled anchor
4 Connection element
5 Formwork
6 Profiled rail screw-fastening
7 Sealing profile
8 Board

The invention claimed is:

1. A profiled rail for fastening to formwork for at least partially embedding in concrete, wherein a) the profiled rail is formed in a substantially C-shaped manner along a profiled rail longitudinal axis by having a rail back with two opposing flanks which protrude at an angle laterally therefrom, wherein the flanks each have at their edges opposite to the rail back wing sections angled towards each other, wherein each wing section has an outer edge which is connected to the respective flank and an inner edge, so that the two inner edges which run towards each other form a parallel rail slit and the two wing sections form a lowest bottom plane in order to bear against the formwork by the lowest bottom plane, wherein a first number of holes, each having a hole cross-section, is formed in the rail back;

b) a second number of plugs, which are inserted into the first number of holes in a distributed manner, c) wherein each plug has, along a central plug longitudinal axis, a cap section and an adjoining through section, wherein the cap section has a first end face and a first outer cross-section which is wider than the hole cross-section so that when the through section is inserted into the respective hole the cap section butts against and is held back from the rail back, wherein the through section has a second end face which is opposite the first end face and has a second outer cross-section which can be fed through the respective hole or pressed therein until the cap section butts against the rail back;

d) wherein each plug has a predetermined pull linkage between an inner section with the feed-through region and an outer section which remains around the plug longitudinal axis, around the outside of the inner section, wherein the inner section has a cross-section which is smaller than the hole cross-section so that it can be pulled through the hole together with the connecting element when the predetermined pull linkage breaks;

e) wherein each plug has, in the direction of the plug longitudinal axis, a feed-through region for an elongate connecting element, said feed-through region being adapted to be manually pierceable by the connecting element and to guide the connecting element thereby;

f) wherein the connecting element is in the form of a nail or a screw having a head and a shaft with a length which is sufficient to connect the plug to the formwork with the profiled rail therebetween.

2. The profiled rail according to claim 1, wherein the respective plug has the predetermined pull linkage between the inner section with the feed-through region and the pull linkage is formed by an annular thinning of the material wall.

3. The profiled rail according to claim 2, wherein the annular thinning of the material wall is formed by a material which can be pulled out of a region of the predetermined pull linkage and is connected to a pulling tab, wherein the pulling tab is preferably located on the side of the through region and is accessible from the rail slit when the plug is mounted in the profiled rail.

4. The profiled rail according to claim 1, also comprising a sealing profile which is formed along the profiled rail longitudinal axis with a sealing profile cross-section and an elasticity such that it can be pressed with the sealing profile cross-section into the rail slit and can thus seal said rail slit towards a profiled rail inner space, wherein the plug has such a length that the second end face of the through section extends at least to the sealing profile which is inserted in the profiled rail, and that as a result the sealing profile is supported towards the profiled rail inner space.

5. The profiled rail according to claim 4, wherein the sealing profile has a groove or a plurality of cup-like cut-outs, having a groove depth or cup depth and a groove cross-section or cup cross-section perpendicular thereto in the direction towards the profiled rail inner space, wherein the groove depth or cup depth is smaller than the height of the sealing profile, and the groove cross-section or cup cross-section is so much smaller than the lower outer cross-section of the through section at the second end face that the through section can be pressed and/or snapped by the lower outer cross-section into the cup cross-section.

6. The profiled rail according to claim 1, wherein the plug has at least one of: a first marking on the first end face; and a second marking on the second end face.

7. The profiled rail according to claim 1, wherein the holes in the profiled rail have the same hole cross-section for the plug as for anchors, profiled or round anchors, which can be inserted therein.

8. The profiled rail according to claim 1, having at least one feature selected from the group of: wherein the rail back is curved convexly outwards in each hole region;

wherein the profiled rail is an anchor rail or profiled anchor rail; and wherein the first number of holes is greater than or equal to the second number of plugs.

9. The profiled rail according to claim 1, including at least one feature selected from: wherein the plug is formed from a plastic material, and the plastic material is elastic with a Shore hardness selected from the group of: 30-60, 80 100;

wherein a head diameter of the connecting element is smaller than the hole cross-section of the holes, so that the head of the connecting element can be pulled through the respective hole; and wherein the formwork consists of wood or a plastic or a metal.

10. A method for mounting a profiled rail on formwork, for casting with concrete, and for subsequent removal of the formwork from the profiled rail, comprising the following steps:

a) providing the profiled rail, which is formed in a substantially C-shaped manner along a profiled rail longitudinal axis having a rail back with two opposing flanks which protrude at an angle laterally therefrom, wherein the flanks each have at edges opposing the rail back wing sections angled towards each other, wherein each wing section has an outer edge which is connected to the respective flank and an inner edge, so that the two inner edges which run towards each other form a parallel rail slit and the two wing sections form a lowest bottom plane to bear against the formwork by the lowest bottom plane, wherein a first number of holes, each having a hole cross-section, is formed in the rail back;

b) inserting a second number of plugs into the holes, wherein each plug has, along a central plug longitudinal axis, a cap section and an adjoining through section, wherein the cap section has a first end face and a first outer cross-section which is greater than the hole cross-section so that the cap section butts against and is held back from the rail back when the through section is inserted into the respective hole, wherein the through section has a second end face which is opposite the first end face and has a second outer cross-section which can be fed through the respective hole or pressed therein until the cap section butts against the rail back;

wherein each plug has, in the direction of the plug longitudinal axis, a feed-through region for an elongate connecting element, said feed-through region being adapted to be manually pierceable by the connecting element and to guide the connecting element;

c) placing the profiled rail with the lowest bottom plane on the formwork;

d) inserting the connecting element, which extends from the rail back at least to the formwork, through the feed-through region into the plug to the formwork and connecting the profiled rail to the formwork by e) embedding the profiled rail up to the formwork in concrete or cement and waiting until the concrete or cement has solidified;

f) pulling the formwork off the profiled rail; and g) pulling the connecting elements out of the profiled rail through the rail slit with a predetermined second pulling force, h) by means of the predetermined second pulling force:

either deforming and opening the plug around the feed-through region so far that a head of the connecting element is pulled through the plug;

or breaking a predetermined pull linkage between an inner region having the connecting element and an outer region of the through section of the plug around it, wherein the inner region together with the connecting element is pulled out of the rail slit.

11. The method according to the preceding claim 9, wherein the profiled rail is connected to the formwork by hammering in a nail or screwing in a screw, as the respective connecting element, through the feed-through region of the plug into the formwork.

12. The method according to the preceding claim 9, wherein the profiled rail is connected to the formwork by welding a bolt, as the connecting element, to a metallic shuttering surface of the formwork.

13. The profiled rail according to claim 1, wherein the respective plug has the predetermined pull linkage between the inner section with the feed-through region and the pull linkage is adapted to hold up to a first pulling force of the connecting element on the plug in the direction of the formwork, in order to pull the profiled rail against the formwork by means of the respective connecting element and the plug at the location of the respective connecting element with at least the first pulling force, and wherein the pull linkage is adapted to tear at a second pulling force or higher between the connecting element and the plug in the direction towards the rail slit, so that the respective connecting element can be pulled out of the plug or out of the hole with the second pulling force.

14. The profiled rail according to claim 1, wherein each plug is adapted, when mounted in the profiled rail, to be detachable and removable again from the profiled rail, so that the anchor can be inserted into a hole from which the respective plug has been removed.

15. The profiled rail according to claim 1, having at least one feature selected from the group including: wherein the hole cross-section of the holes and the through section of the plug are adapted, such that the through section is elastic and wider than the hole cross-section in a wedging region, which is close or adjacent to the cap section, to such an extent, that the plug can be pressed into the hole with the through section first as far as up to the cap section, and wedges therein and is manually detachable and removeable therefrom;

wherein the feed-through region of the plug is substantially leakproof to liquid concrete when in a state before the connecting element has been pierced through; and wherein the through section of the plug is formed with a latching shoulder which is adapted and arranged such that, when the plug is mounted in the profiled rail, said latching shoulder presses against the profiled rail from a rear face and prevents the plug from being pulled out of the profiled rail up to a predetermined pulling force.

16. A profiled rail for fastening to formwork for at least partially embedding in concrete, wherein a) the profiled rail is formed in a substantially C-shaped manner along a profiled rail longitudinal axis by having a rail back with two opposing flanks which protrude at an angle laterally therefrom, wherein the flanks each have at their edges opposite to the rail back wing sections angled towards each other, wherein each wing section has an outer edge which is connected to the respective flank and an inner edge, so that the two inner edges which run towards each other form a parallel rail slit and the two wing sections form a lowest bottom plane in order to bear against the formwork by the lowest bottom plane, wherein a first number of holes, each having a hole cross-section, is formed in the rail back;

b) a second number of plugs, which are inserted into the first number of holes in a distributed manner, c) wherein each plug has, along a central plug longitudinal axis, a cap section and an adjoining through section, wherein the cap section has a first end face and a first outer cross-section which is wider than the hole cross-section so that when the through section is inserted into the respective hole the cap section butts against and is held back from the rail back, wherein the through section has a second end face which is opposite the first end face and has a second outer cross-section which can be fed through the respective hole or pressed therein until the cap section butts against the rail back;

d) wherein each plug is so elastic in the feed-through region that, when the profiled rail is mounted on the formwork, the connecting element is held back by the head in the feed-through region of the plug sufficiently firmly up to a first pulling force to hold the profiled rail on the formwork, and that at least at a second pulling force of the connecting element in the direction of the rail slit the feed-through region yields to the head of the connecting element, so that the connecting element is pulled with the head through the feed-through region;

e) wherein each plug has, in the direction of the plug longitudinal axis, a feed-through region for an elongate connecting element, said feed-through region being adapted to be manually pierceable by the connecting element and to guide the connecting element thereby;

f) wherein the connecting element is in the form of a nail or a screw having a head and a shaft with a length which is sufficient to connect the plug to the formwork with the profiled rail therebetween.

17. The profiled rail according to claim 16, wherein the plug has at least one of: a first marking on the first end face and a second marking on the second end face.

* * * * *